US008773276B2

(12) United States Patent
Savage, Jr.

(10) Patent No.: US 8,773,276 B2
(45) Date of Patent: Jul. 8, 2014

(54) DUAL MODE LED STROBE

(75) Inventor: Kenneth E. Savage, Jr., Fitchburg, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 471 days.

(21) Appl. No.: 13/160,185

(22) Filed: Jun. 14, 2011

(65) Prior Publication Data

US 2012/0319861 A1 Dec. 20, 2012

(51) Int. Cl.
*G08B 5/22* (2006.01)

(52) U.S. Cl.
USPC ..... 340/815.45; 340/332; 340/691.8; 362/276

(58) Field of Classification Search
USPC ..... 340/815.45, 691, 331, 332; 362/276, 362/800, 802; 315/291, 294, 297
See application file for complete search history.

(56) References Cited

U.S. PATENT DOCUMENTS

| | | | | |
|---|---|---|---|---|
| 5,559,492 | A | 9/1996 | Stewart et al. | |
| 6,483,254 | B2 | 11/2002 | Vo et al. | |
| 7,456,585 | B2 | 11/2008 | Savage, Jr. et al. | |
| 2002/0101189 | A1 | 8/2002 | Vo et al. | |
| 2005/0128097 | A1 * | 6/2005 | Piccolo et al. | 340/691.1 |
| 2005/0157205 | A1 | 7/2005 | Voss et al. | |
| 2006/0255705 | A1 | 11/2006 | Young | |
| 2008/0272911 | A1 | 11/2008 | Krippendorf et al. | |
| 2009/0072989 | A1 * | 3/2009 | Rock et al. | 340/691.1 |
| 2009/0091466 | A1 | 4/2009 | Sendrowski | |
| 2009/0261737 | A1 * | 10/2009 | Wright et al. | 315/297 |
| 2010/0207777 | A1 | 8/2010 | Woodford | |
| 2011/0133649 | A1 * | 6/2011 | Kreiner et al. | 315/297 |

FOREIGN PATENT DOCUMENTS

| | | |
|---|---|---|
| EP | 1 622 106 | 2/2006 |
| GB | 1 437 033 | 5/1976 |

OTHER PUBLICATIONS

International Search Report and Written Opinion issued in corresponding PCT Appln. No. PCT/US2012/039827 dated Aug. 21, 2012 (13 pgs).

* cited by examiner

*Primary Examiner* — Thomas Mullen
(74) *Attorney, Agent, or Firm* — Brinks Gilson & Lione

(57) ABSTRACT

A strobe device that operates in multiple modes is disclosed. The strobe device may include an LED-based strobe element and a controller. In response to receiving a command to generate an output, the controller determines in which of at least a first mode and second mode to operate, and sends one or more signals to the LED-based strobe element based on the determination. The first mode and the second mode may differ from one another in at least one aspect, such as duration, luminosity, current supplied to LED, or wavelength range. The controller may select both of the first mode and the second mode (such as alternating between the first mode and the second mode). Or, the controller may select one of the first mode and the second mode. For example, depending on the ambient light at or near the strobe device, the controller may select either the first mode or the second mode.

17 Claims, 6 Drawing Sheets

DUAL MODE LED STROBE

BACKGROUND

Fire alarm devices such as audible horns (audible/visible or A/V), loudspeakers (speaker/visible or S/V) and visible strobes (visible only or V/O), are referred to as "notification appliances." Typically, a fire alarm control panel (FACP) drives these devices over one or more "notification appliance circuits" (NACs). The strobes are used, for example, as an alert for the hearing-impaired, or for those in a high noise environment.

One type of strobe uses a flash tube (also called a flash lamp). Typically, the flash tube is an electric glow discharge lamp designed to produce extremely intense, incoherent, full-spectrum white light for very short durations. Flash tubes are made of a length of glass tubing with electrodes at either end and are filled with a gas that, when triggered, ionizes and conducts a high voltage pulse to produce the light. Xenon is an example of the gas that can fill the flash tube, with a Xenon flash tube producing a high-intensity light (such as hundreds of thousands of lumens) for a very short duration pulse (such as hundreds of milliseconds). Xenon flash tubes use a high voltage storage element, such as an electrolytic capacitor, that can be charged several hundred volts to provide energy for the flash. Xenon flash tubes also use a trigger voltage that is in the several thousand volt range to start the gas discharge.

The lifetime of the flash tube can depend on both the energy level used for the lamp in proportion to its discharge energy, and on the pulse duration of the lamp. Failures can be catastrophic or can be gradual, reducing the performance of the lamp below a usable rating.

Another type of strobe is Light Emitting Diode (LED)-based. An LED-based strobe cannot generate light at as high of an intensity as a Xenon-based strobe. Instead, LED-based strobes generate a lower intensity light (such as hundreds of lumens) for a longer period of time (such as tens to hundreds of milliseconds). In this way, the LED-based strobes can generate a comparable amount of light energy, as measured in candela, as a Xenon-based strobe. Further, an LED-based strobe is a semiconductor device that can be run off a lower voltage than a Xenon-based strobe, thus eliminating the high voltage circuitry. A capacitor may still be used for energy storage in the LED-based strobe, albeit for a lower output voltage. Because of its physical characteristics, an LED-based strobe can be turned on either continuously or pulsed. Factors that may limit the light output of the LED-based strobe are junction temperature and luminosity versus current, as determined by the LED chip materials and bonding wires. Finally, in contrast to flash-tube based strobes, LED-based strobes typically have a longer usable lifetime. However, LED-based strobes still lack the extremely intense light output generated by a flash tube based strobe.

SUMMARY

The present embodiments relate to a strobe notification device that includes a strobe element that operates in a first mode and a second mode, with the first mode being different from the second mode. In one embodiment, the strobe element for the strobe notification device is an LED-based strobe element.

There may be one or more differences between the first mode of operation and the second mode of operation. One difference may be the duration of operation (such as a shorter operation time for the first mode than for the second mode). For example, the duration for the first mode may be milliseconds and the duration for the second mode may be tens of milliseconds. Another difference may be the amount of luminosity output or light intensity (such as a greater luminosity for the first mode than for the second mode). For example, the strobe element in the first mode may output 1300-1600 lumens for first mode and may output 200-1000 lumens in the second mode. Yet another difference is the amount of current driving the strobe element. In an LED-based strobe element, the first mode may operate with a higher current whereas the second mode may operate with a lower current. Still another difference is the wavelength range output. For example, the strobe element may output a different color (such as a bluer output) in the first mode than the output in the second mode.

The strobe notification device may generate an output in response to receipt of a command, the command indicative of commanding the strobe notification device to generate an output. In response to receipt of the command to generate an output, the strobe notification device may operate in the first mode, the second mode, and/or both the first mode and the second mode. A controller of the strobe notification device may determine whether to operate in the first mode, the second mode, or in both the first mode and the second mode, and send control signals to the LED-based strobe element to operate the LED-based strobe element based on the determination. For example, the strobe element may operate in both the first mode and the second mode, such as the controller sending one or more control signals to the LED-based strobe element in order for the LED-based strobe element to alternate operation between the first mode and the second mode.

Because of the higher intensity output in the first mode and/or because of the contrast in intensity of the first and second modes (such as when alternating), the LED-based strobe element may provide a notification akin to a flash tube based strobe element (with its extremely intense output) without the need to use the flash tube based strobe element. In particular, the LED-based strobe element may operate with similar effectiveness to a Xenon-based strobe element in which the LED-based strobe element is driven in two different modes. The first mode may be a high-current short duration pulse, which may provide the highest intensity (or close to the highest intensity) available from the LED. The short duration pulse may be a multiple of the maximum rated current (such as two or three times the maximum rated current. Moreover, the short duration pulse may be greater than at the maximum rated current (such as approximately 1.7 times or less). The second mode may be a longer duration, lower current pulse. This operation may provide the average energy to increase the perceived brightness. The two modes may be combined to create a single flash pulse. The strobe light output rating may be determined using the Blondel-Rey equation, which measures the average light energy in candela. So that, different candela ratings may be achieved by varying the second mode pulse duration and/or drive current.

As another example, the controller of the strobe notification device may select only one mode for operation of the LED-based strobe element, such as only operating in the first mode or in the second mode, and in response to the selection, operate the LED-based strobe element in the selected mode. The controller may receive an input external to the strobe in order for the controller to make the selection. The strobe notification device may be an addressable strobe notification device (e.g., the strobe notification device has a uniquely assigned address) or a non-addressable strobe notification device.

In one aspect, the input may be based on an environmental condition external to the strobe (such as the ambient light proximate to or near the strobe notification device). For example, the strobe notification device may optionally include a sensor to sense the ambient light proximate to the strobe notification device. The sensor may generate an indication of the amount of ambient light and provide this indication as an input to the controller. In response to receiving the indication of the amount of ambient light, may select one of the modes of operation in which to operate the LED-based strobe element.

Dark ambient research data indicates a higher perceived brightness with longer pulse durations. In bright ambient, the shorter, high intensity pulse may be more noticeable. Given this, in dark ambient, a mode with a longer pulse duration (such as the second mode) may be a more effective strobe output than a mode with a shorter pulse duration (such as the first mode). Moreover, in bright ambient, a mode with a shorter duration and higher intensity may be selected (such as the first mode) and may be more effective in notifying a building's occupants than a longer pulse duration of lower intensity (such as the second mode). Ambient light for a given strobe installation may vary, and can be either bright or dark depending on the time of day or location. The controller may receive the amount indicative of ambient light from the sensor, such as sensing the amount of light in real-time after receipt of the command to generate an output, and select one of the modes of operation based on the sensed amount of ambient light. In one example, a single predetermined level determines which of the first mode and the second mode to select. If the amount indicative of ambient light is greater than the predetermined amount, the LED-based strobe element is operated in the first mode. If the amount indicative of ambient light is less than the predetermined amount, the LED-based strobe element is operated in the second mode. In a second example, multiple predetermined levels determine which of the first mode and the second mode to select. If the amount indicative of ambient light is greater than a first predetermined amount, the LED-based strobe element is operated in the first mode. If the amount indicative of ambient light is less than a second predetermined amount, the LED-based strobe element is operated in the second mode. If the amount indicative of ambient light is less than the first predetermined amount and greater than the second predetermined amount, the LED-based strobe element is operated in both the first mode and the second mode (such as alternating between the first mode and the second mode).

In another aspect, the input to the controller to determine in which mode to operate may be based on a message sent from a device external to the strobe device, such as a fire alarm controller. The message may be a part of the command received by the strobe notification device to generate an output. For example, the message may be a field within the command. The field may indicate which of the first mode or the second mode, or both of the first mode and the second mode is to be implemented. The controller may then select the mode(s) of operation by which to operate as indicated in the message.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

Figure 1:
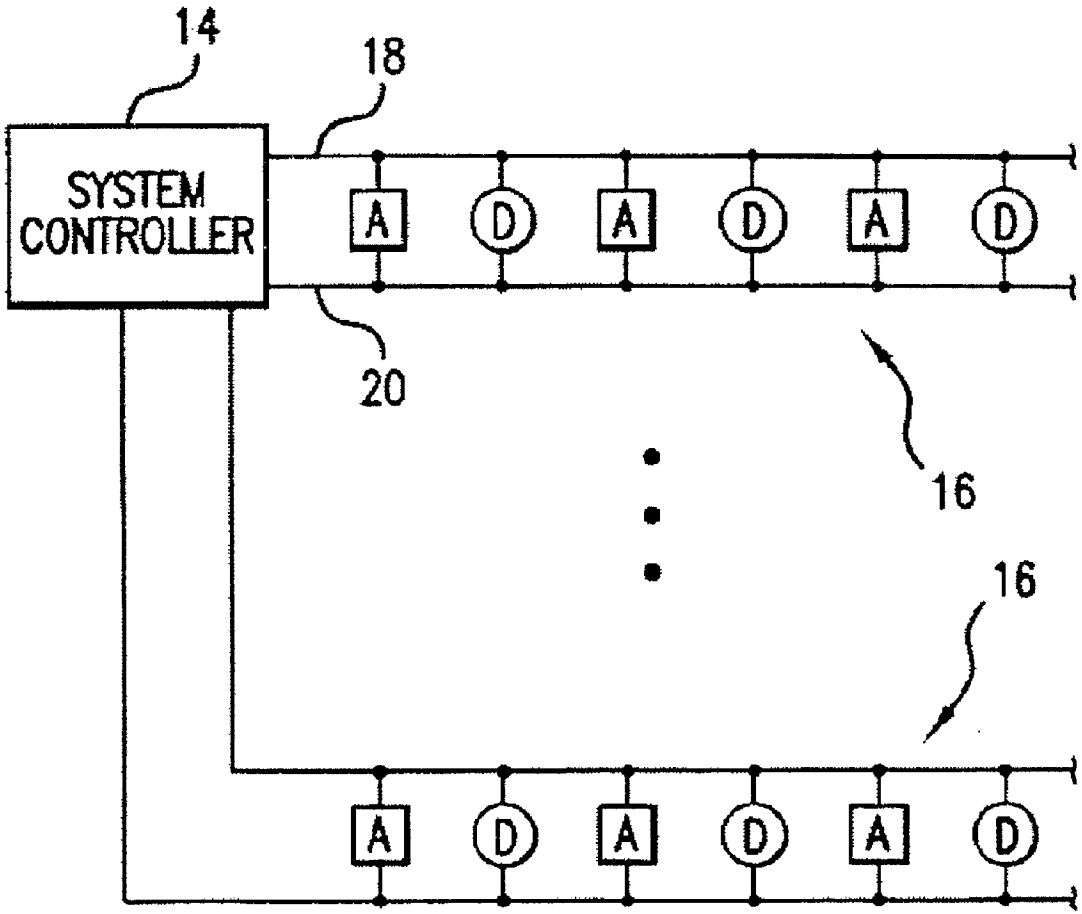
FIG. 1 is a schematic diagram illustrating a fire alarm system.

A system embodying one example of the present invention is illustrated in FIG. 1. The system includes one or more notification appliance circuits (NACs), i.e., networks 16, having alarm condition detectors D and alarm system notification device A. Alternatively, the detectors and notification devices may be on separate networks. A system controller (such as a fire alarm control panel (FACP)) 14 may monitor the detectors D.

The system controller 14 may monitor the alarm condition detectors D. When an alarm condition is sensed, the system controller 14 may signal the alarm to the appropriate notification appliances A through the one or more appliance circuits. Notification devices may include, for example, a visual alarm (such as a strobe), an audible alarm (such as a horn), or a combination thereof.

Although not necessary for carrying out the invention, as shown, all of the notification devices in a network are coupled across a pair of power lines 18 and 20 that advantageously also carry communications between the system controller 14 and the detectors D and notification devices A.

The system controller 14 may comprise a fire alarm control panel and may use one or more commands to signal the alarm to the appropriate notification appliances A. Examples of commands issued for a system with addressable notification appliances are disclosed in U.S. Pat. No. 6,426,697, which is hereby incorporated by reference in its entirety. Alternatively, the communication line to the device may be separate from the power line. In still an alternative embodiment, the system may include non-addressable notification appliances. The communications channel may comprise, for example, a wireless link, a wired link or a fiber optic link.

Further, the system controller 14 may send one or more commands relating to diagnostics, status, or other non-alarm type events. For example the system controller 14 may send a command related to the identification, the configuration, and/or the status of the notification appliances A. Moreover, the notification appliances A may respond in kind.

One, some, or all of the notification devices A may comprise a strobe device. The strobe device may be an addressable strobe notification device (e.g., the strobe notification device has a uniquely assigned address) or a non-addressable strobe notification device. Further, the strobe device may operate in one of multiple modes, such as a first mode and a second mode. In one embodiment, the first mode is different from the second mode in one or more ways. Examples of differences in the modes include, without limitation: duration of the modes; intensity of the modes; and output wavelength of the modes.

As discussed in more detail below, the fire alarm control panel may send a command to one or more strobes to active the strobe element associated with the strobe.

Figure 2:
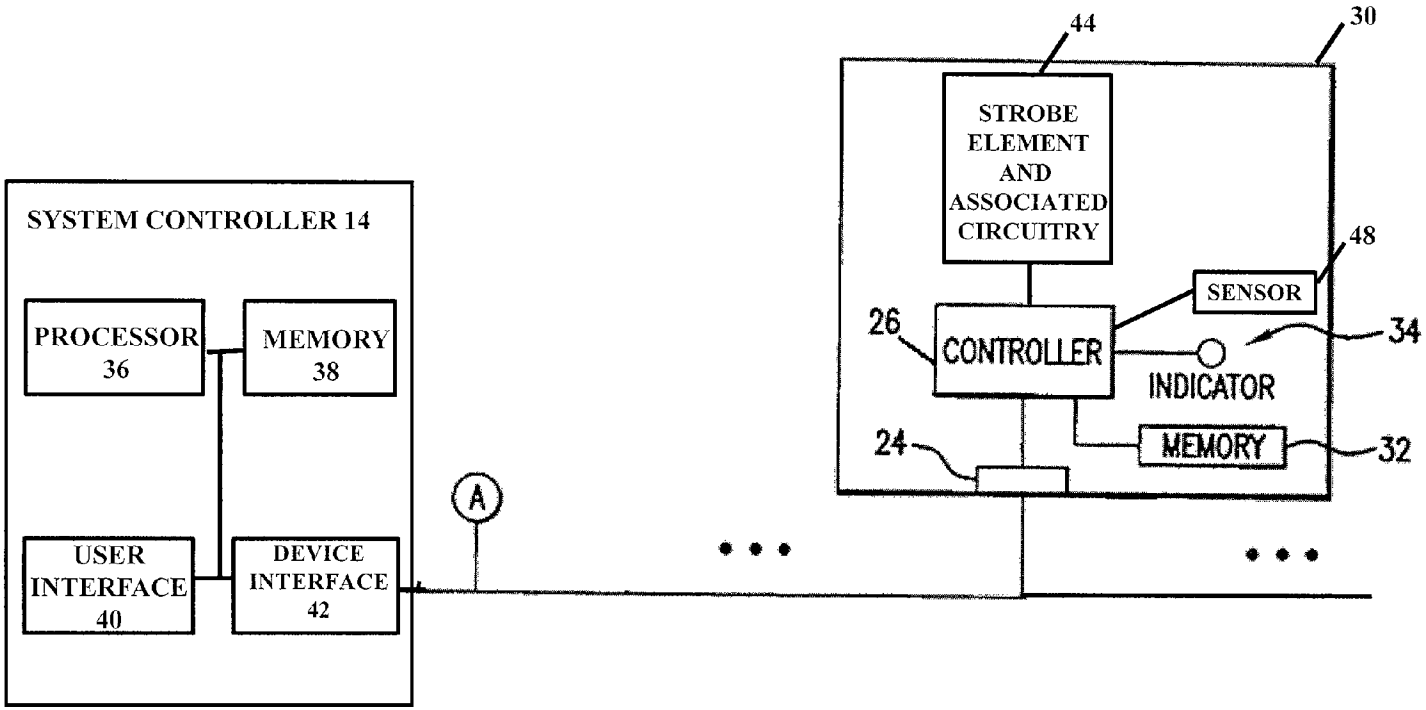
FIG. 2 is a schematic diagram of the system of FIG. 1, further illustrating details of a system controller and a strobe device.

FIG. 2 is a schematic diagram of a part of the system shown in FIG. 1, further illustrating details of the system controller 14 and one of the notification appliances. The system controller 14 includes a processor 36, a memory 38, a user interface 40, and a device interface 42. The processor 36 may comprise a microprocessor, a microcontroller, a digital signal processor, an application specific integrated circuit (ASIC), a field programmable gate array, a logical digital circuit, or other now known or later developed logical processing capability. The processor 36 may work in combination with the memory 38 in order to monitor part or all of the fire alarm system, including one or more of the appliance circuits (such as one or more notification appliance circuits, one or more detector circuits, and/or one or more notification appliance/detector circuits). In addition, the memory may include one or more look-up tables (or other data structures) used for configuration.

User interface 40 may be used by an operator to control configuration and/or operation of the alarm condition detectors D and alarm system notification appliances A. And, device interface 42 may be an example of a communications interface, and may comprise the interface between the system controller 14 and the alarm condition detectors D and alarm system notification appliances A in the one or more appliance circuits.

FIG. 2 further depicts a strobe device 30 in greater detail. The strobe device 30 connects to the network 16 via a network interface (communication connection) 24. The strobe device 30 receives one or more commands from the system controller 14. The controller 26 processes the one or more commands, as discussed in more detail below. Although shown separately, the memory 32 may be integrated with the controller 26.

The strobe device 30 further includes strobe element and associated circuitry 44. In one example, the strobe element is an LED-based strobe element. In one embodiment, the controller 26 determines in which (if not both) of first mode or the second mode to operate, and sends commands to activate the strobe element to operate accordingly.

The first mode and the second mode of operation may differ in one or more ways or aspects including without limitation: duration, luminosity, current, and wavelength output. For example, the first mode may have a shorter operation time than the second mode. In particular, the duration for the first mode may be milliseconds and the duration for the second mode may be tens of milliseconds. As another example, the first mode may generate an output with a greater luminosity or light intensity. In particular, the strobe in the first mode may output 1300-1600 lumens for first mode and may output 200-1000 lumens in the second mode. In yet another example, the first mode may use a higher current than the second mode. In particular, in an LED-based strobe element, the first mode may operate with a higher current whereas the second mode may operate with a lower current. In still another example, the first mode may output a different wavelength range than the second mode. In particular, the strobe may output a different color (such as a bluer output) in the first mode than the output in the second mode.

In an LED-based strobe element, the light output from the LED is typically specified with a given luminosity at a rated continuous current. The relationship of luminosity to current may be linear around the rated current, and then may become non-linear as current increases and luminosity falls off as junction temperatures increase. In pulsed operation, the current may be increased to generate more light output than the continuous current rating; however, the device may need to maintain operation within its specifications for junction temperature and care needs to be taken not to drive the device so hard or too long as to damage the chip itself or its internal connections. Further, a notable effect with white LEDs is that they may change their color output (such as to a blue hue) with higher pulsed currents, thus providing an effect similar to a Xenon flash but at a lower intensity. Given this, the first mode (with the higher intensity output) may be used to generate an output with a higher current, but with a shorter duration.

In one aspect, in response to receipt of a command to activate the strobe element, the strobe device 30 is pre-programmed to operate the strobe element in both the first mode and the second mode, such as alternating between operation in the first mode and operation in the second mode. Alternating the operation of the strobe element between different modes (such as the first mode and the second mode) may improve notification in different ambient lighting conditions.

The pre-programming of the strobe device 30 may be performed at manufacture of the strobe device 30 and stored in memory 32. Or, the pre-programming of the strobe device 30 may be performed prior to receipt of the command to activate the strobe device (such as during installation/configuration of the fire alarm system). For example, the system controller 14 may send a configuration command to the strobe device to pre-program the strobe device 30. As another example, a technician may input the configuration command via an input device (not shown), local to the strobe device 30.

In another aspect, the strobe device 30 may determine in which (or both) of the first mode or the second mode to operate. The determination of which mode to operate may be based on a dynamic or changing condition. One example of a dynamic or changing condition is ambient lighting. The strobe device 30 may optionally receive an indication of the ambient lighting via sensor 48. The sensor 48 may include a photosensor or photodetector that detects light in a predetermined wavelength range, such as the visible light range. As discussed in more detail below, the sensor 48 may sense the amount of ambient light prior to the controller determining in which mode to operate. For example, the sensor 48 may sense the amount of ambient light at predetermined times (such as once per hour) and store a value indicative of the amount of ambient light in memory 32. As another example, the sensor 48 may sense the amount of ambient light in response to the strobe device 30 receiving a command to activate the strobe element. Alternatively, the strobe device 30 does not include a sensor to sense an indication of ambient light.

The controller 26 may receive the amount indicative of ambient light from the sensor 48. The controller 26 may then select one of the modes in which to operate based on the sensed amount of ambient light. In one example, the controller 26 compares the amount indicative of ambient light to a single predetermined level.

If the amount indicative of ambient light is greater than the predetermined amount, the first mode is selected. As discussed above, the first mode has a higher intensity and a shorter duration than the second mode. If the amount indicative of ambient light is less than or equal the predetermined amount, the second mode is selected. As discussed above, the second mode has a lower intensity and a longer duration that the first mode. Alternatively, the controller may comprise analog circuitry with the amount indicative of ambient light may be input to the analog circuitry. The predetermined amount may be set by an input device, such as a switch or a jumper setting, which may be located on the strobe device 30.

In a second example, the controller 26 compares the amount indicative of ambient light to multiple predetermined levels in order to determine which of the first mode and the second mode to select. If the amount indicative of ambient light is greater than a first predetermined amount, the first mode is selected. If the amount indicative of ambient light is less than a second predetermined amount, the second mode is selected. If the amount indicative of ambient light is less than the first predetermined amount and greater than the second predetermined amount, both the first mode and the second mode are selected.

In an office environment, the minimum illuminance may be approximately 300 lux. In a home environment (such as a living room), the ambient light level may be a minimum illuminance of 100 lux. The sensor 48 may output a voltage value for a given amount of light. The voltage value may then be sent to a group of discrete level detectors or may be input to an A to D converter. The levels from the sensor may then be used select the appropriate mode. For example, a second mode with a lower intensity flash may used below 100 lux. A combination of both first mode and second mode flashes may be used between 100 and 300 lux. Further, a higher intensity flash (such as used in the first mode) may be used at 300 lux and above.

In some embodiments, an indicator 34, such as a flashing LED (separate from the strobe element and associated circuitry 44), may be used as an output, for example during diagnostic testing, on the strobe device 30. The indicator 34 may be activated, for example, upon command from the system controller 14, upon a local manual command such as a pushbutton (not shown).

After the controller 26 determines in which (or both) of the first mode and the second mode to operate, the controller sends one or more control signals in order to control the operation (including controlling operation of the strobe element to be in the first mode and/or the second mode). One example of an LED-based strobe element is disclosed in U.S. Patent Application No. 2008/0272911, herein incorporated by reference in its entirety.

Figure 3:
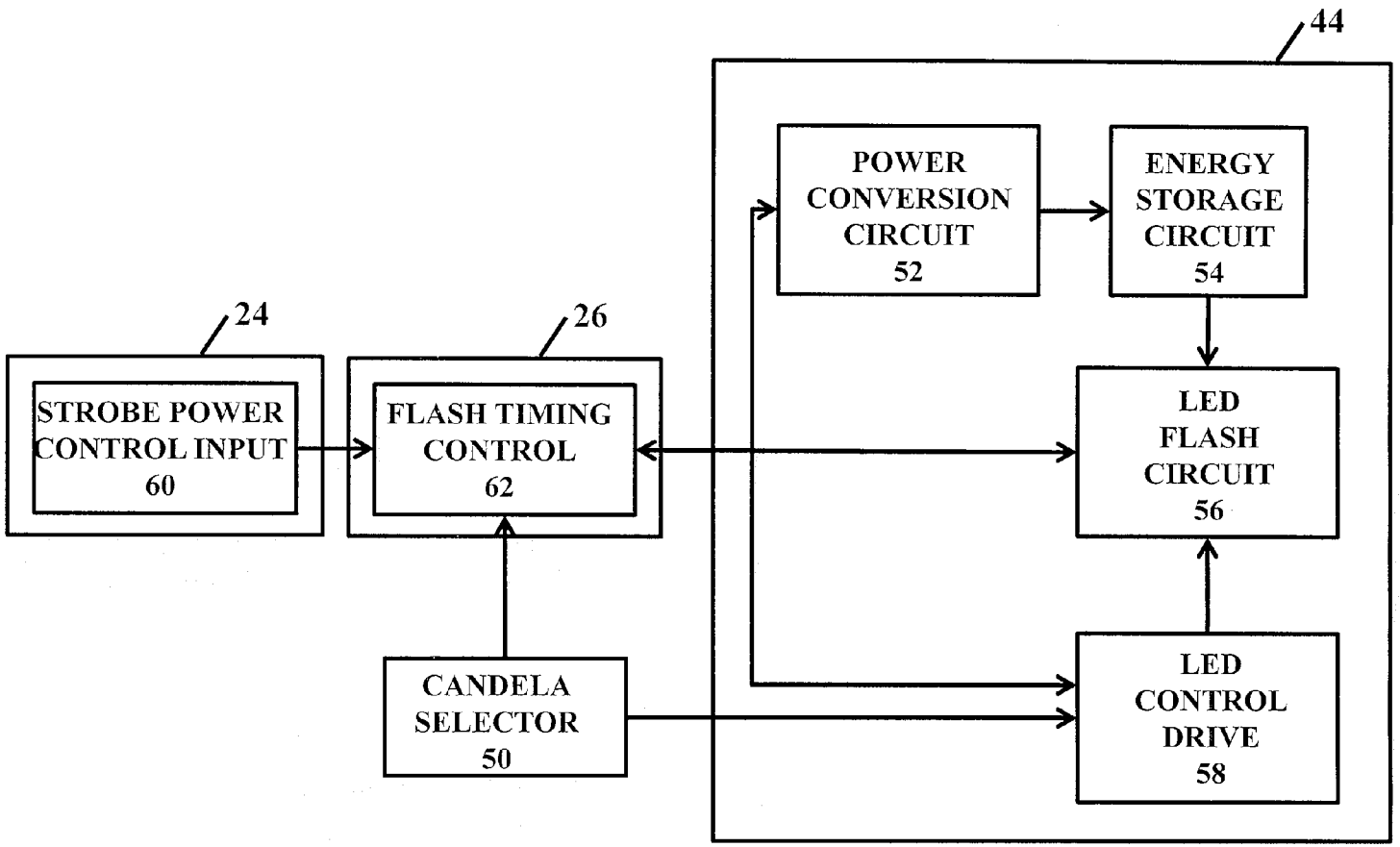
FIG. 3 illustrates an expanded block diagram of the strobe device (including strobe element and associated circuitry) illustrated in FIG. 2.

Referring to FIG. 3, there is shown an expanded block diagram of the strobe device illustrated in FIG. 2. The network interface 24 includes a strobe power control input 60 that receives the command to activate the strobe device 30 and receives power to power the strobe device 30. The strobe power control input 60 sends the received command to the controller 26. The controller 26 includes flash timing control 62, which controls the timing of the flashes of the strobe element. The flash timing control 62 may receive as an input the candela selector 50, which may be an input device on the strobe device 30 (such as a multi-position switch). An example of the switch is disclosed in U.S. Pat. No. 7,456,585, incorporated by reference herein in its entirety. Examples of candela settings include 15, 30, 75, and 110. Alternatively, the candela setting may be pre-programmed and stored in memory 32. Based on the candela setting, the flash timing control 62 may control the strobe element and associated circuitry 44 to generate an output with the desired candela setting. One example of the strobe element and associated circuitry 44 is illustrated in FIG. 3, including an LED flash circuit 56, a power conversion circuit 52, energy storage circuit 54, and LED control drive 58. The power conversion circuit 52 provides the proper regulated voltage to the energy storage circuit 54. An example of the power conversion circuit 52 may be a voltage regulator (such as a DC-DC converter or current regulator), and an example of the energy storage circuit 54 may be a capacitor. The flash timing control circuit 62 generates an output to the LED control drive 58. Based on the output, the LED control drive 58 provides the proper current to the LED flash circuit 56 in order for the LED flash circuit 56 to generate the desired intensity. Further, the flash timing control 62 generates an output to LED flash circuit 56, which dictates the duration of the output of the LED flash circuit 56. Thus, the flash timing control 62 may control both the intensity and the duration in order generate an output with the requested candela rating (as dictated by candela selector 50). The flash timing control 62 further may communicate with the power conversion circuit 52 in order for the power conversion circuit 52 to provide the proper voltage to energy storage circuit 54.

Thus, upon receiving the activation signal (such as in the form of a command received by network interface 24), the power conversion circuit 52 may charge up the storage capacitor in energy storage circuit 54. When the strobe element is activated, the flash timing control 62 may initialize the power conversion circuit 52 to charge the energy storage circuit 54, as well as configure the LED control drive 58. This may be applicable to a notification appliance that is addressable. In a non-addressable notification appliance, the flash timing control may be set directly (such as locally on the non-addressable notification appliance). When a flash signal is received, the timing control circuit will generate the first mode and second mode drive current patterns for each flash cycle until the strobe is deactivated (such as shown in FIG. 4).

Figure 4:
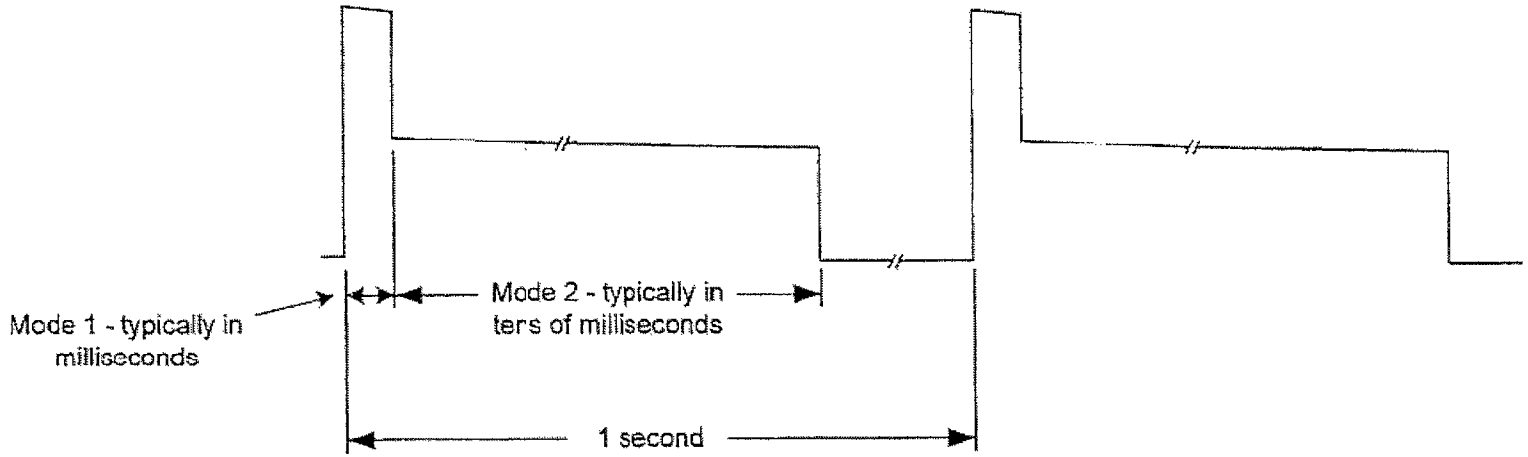
FIG. 4 is an exemplary output of the strobe device, including alternating operation of the strobe device in the first mode and the second mode.

FIG. 4 illustrates an example of the pattern of light output for the strobe device 30. As shown in FIG. 4, the light alternates between a first mode (Mode 1) and a second mode (Mode 2). As shown, the first mode includes a higher luminosity and a shorter duration (on the order of milliseconds). The second mode includes a lower luminosity and a longer duration (on the order of tens of milliseconds). The cycle of the first mode and second mode can repeat, such as every 1 second, as shown in FIG. 4. As shown in FIG. 4, the first mode is followed immediately by the second mode (with no interim period of no luminosity). After the second mode, the LED is turned off, resulting in no luminosity being output by the LED.

Different sequences than that depicted in FIG. 4 may be used. For example, the sequence may be the first mode, followed by no luminosity (no light output by the LED), then followed by the second mode, followed by no luminosity. As another example, the second mode may be immediately followed by the first mode, then followed by no luminosity. As still another example, the second mode may be immediately followed by the first mode, which may be immediately followed by the second mode again, followed by no luminosity. As still another example, the first mode may occur at the start, at the end, or anytime during the second mode. These examples are merely for illustration purposes only. Other sequences are contemplated. Further, the various sequences may be repeated.

Moreover, FIG. 4 depicts two modes (Mode 1 and Mode 2). In an alternative embodiment, more than two modes may be used. For example, three or four modes may be used in a single sequence. Each of the modes may differ from each other in at least one aspect, such as discussed above. Further, the first mode (Mode 1) is depicted as the leading pulse in FIG. 4. Alternatively, the first mode (Mode 1) may occur as a trailing pulse or during the second mode (Mode 2).

Figure 5:
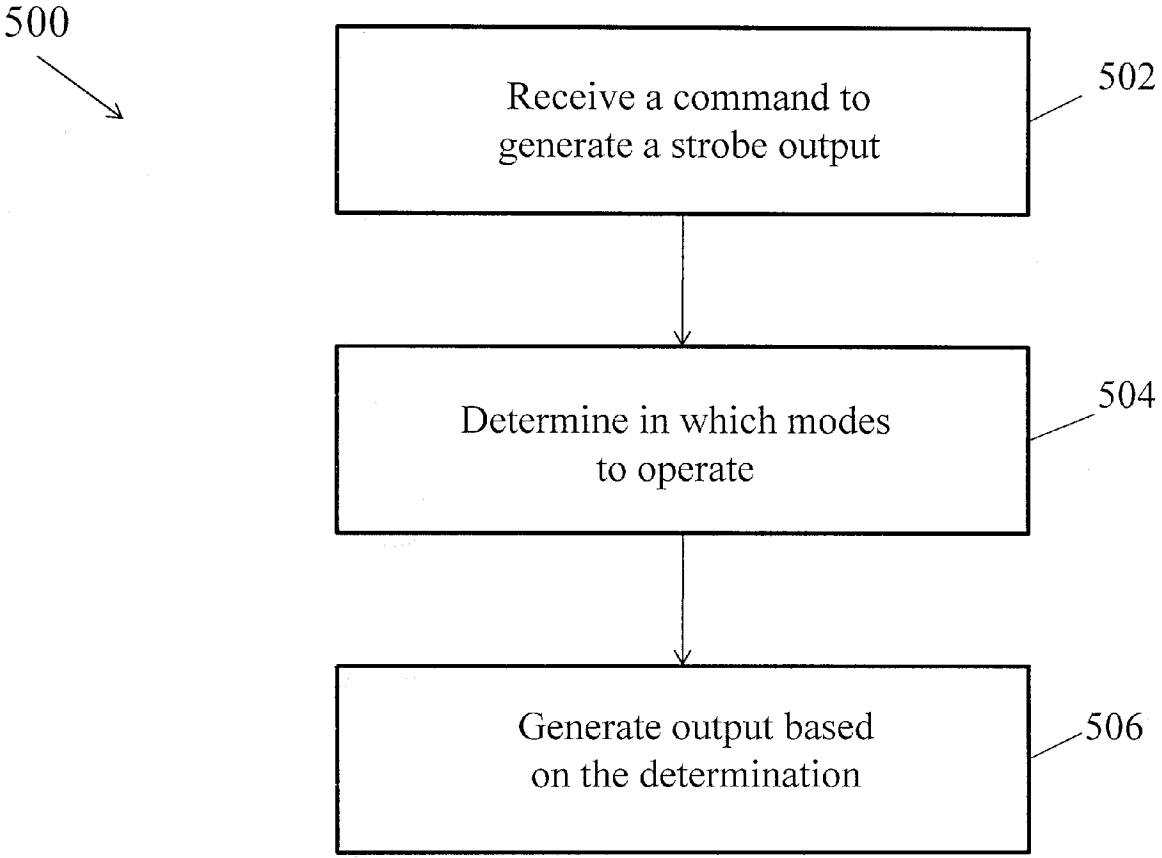
FIG. 5 is an exemplary flow chart of operation of the strobe device.

Referring to FIG. 5, there is illustrated a flow chart 500 for operating the strobe device. At block 502, the strobe device receives a command to generate a strobe output. At block 504, the strobe device determines in which of the modes to operate. As discussed above, the controller 26 may determine whether to operate in the first mode, the second mode, or both the first mode and the second mode. In one embodiment, the strobe device is pre-programmed to operate both in the first mode and in the second mode, so that the determination includes accessing a memory location that stores the pre-programmed pattern of output. In an alternative embodiment, the strobe element receives an indication from an external device (such as the system controller 14) in which (or both) of the modes to operate. The indication may be included in the command to generate the strobe output. The controller of the strobe device may review the command in the strobe device determining in which of the modes to operate. In still another embodiment, the strobe device may obtain a sensor reading, such as a reading of an ambient light level. As discussed in more detail in FIG. 6, the strobe device may determine in which (or both) of the modes to operate based on the sensor reading. As shown at block 506, the strobe device generates the output based on the determination.

Figure 6:
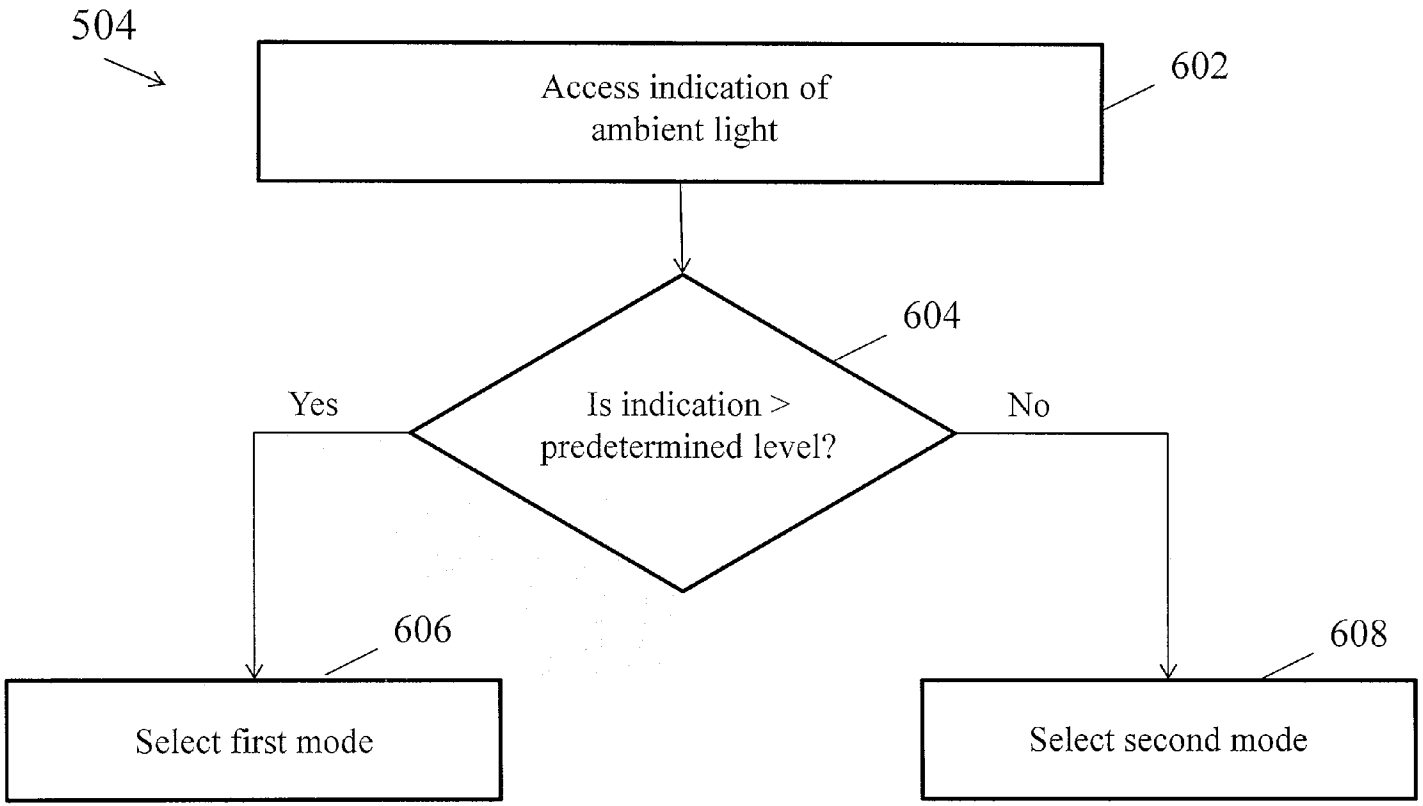
FIG. 6 is an exemplary flow chart of determining in which mode to operate the strobe.

Referring to FIG. 6, there is shown a flow chart of one example of the determination in which modes to operate (block 504 in FIG. 5). At block 602, an indication of the ambient light is accessed. The indication of the ambient light may be stored in a memory, such as memory 32, based on a sensor reading from sensor 48 taken prior to receipt of the command to activate the strobe device. Alternatively, a real-time sensor reading from sensor 48 may be taken in response to receipt of the command to activate the strobe device. The indication of the ambient light is compared to at least one predetermined level, as shown at 604. In one aspect, only a single predetermined level is used (as illustrated in FIG. 6). Alternatively, multiple predetermined levels may be used, as discussed above. If the indication of the amount of ambient light is greater than the predetermined level, the first mode is selected, as shown at 606. If the indication of the amount of ambient light is less than or equal to the predetermined level, the second mode is selected, as shown at 608.

While the invention has been described with reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. A strobe notification device for use in an alarm system, the strobe device comprising:

a strobe element; and a controller in communication with the strobe element and configured to:

receive a command to activate the strobe element;

in response to receiving the command to activate the strobe element, iteratively:

control the strobe element to operate in a first mode; and control the strobe element to operate in a second mode, wherein the first mode and the second mode both have non-zero luminosity, and wherein the first mode has at least one aspect of operation different from the second mode.

2. The strobe notification device of claim 1, wherein the strobe element includes an LED-based strobe element.

3. The strobe notification device of claim 1, wherein the first mode and the second mode differ in at least two of the following: duration, luminosity, and wavelength range.

4. The strobe notification device of claim 1, wherein the first mode differs from the second mode in duration and luminosity.

5. The strobe notification device of claim 1, the controller is configured to iteratively control the strobe element to operate in the first mode and the second mode by controlling the strobe element to alternate operation between the first mode and the second mode.

6. The strobe notification device of claim 5, wherein the strobe element operating in the first mode has a higher luminosity than the strobe element operating in the second mode; and wherein the strobe element operating in the first mode has a shorter duration than the strobe element operating in the second mode.

7. The strobe notification device of claim 6, wherein the strobe element operating in the first mode is on the order of milliseconds and the strobe element operating in the second mode is on the order of tens of milliseconds.

8. A method for operating a strobe notification device in an alarm system, the method comprising:

receiving a command to activate a strobe element of the strobe notification device; and in response to receiving the command to activate the strobe element, iteratively:

controlling the strobe element to operate in a first mode; and controlling the strobe element to operate in a second mode, wherein the first mode and the second mode both have non-zero luminosity, and wherein the first mode has at least one aspect of operation different from the second mode.

9. The method of claim 8, wherein the strobe element includes an LED-based strobe element.

10. The method of claim 8, wherein the first mode and the second mode differ in at least two of the following: duration, luminosity, and wavelength range.

11. The method of claim 8, wherein the first mode differs from the second mode in duration and luminosity.

12. The method of claim 8, wherein iteratively controlling the strobe element to operate in the first mode and the second mode comprises controlling the strobe element to alternate operation between the first mode and the second mode.

13. The method of claim 12, wherein the strobe element operating in the first mode has a higher luminosity than the strobe element operating in the second mode.

14. The method of claim 13, wherein the strobe element operating in the first mode has a shorter duration than the strobe element operating in the second mode.

15. The method of claim 14, wherein the strobe element operating in the first mode is on the order of milliseconds and the strobe element operating in the second mode is on the order of tens of milliseconds.

16. The method of claim 15, wherein controlling the strobe element to alternate operation between the first mode and the second mode comprises controlling the strobe element to repeat operation in the first mode, in the second mode, and in a third mode every predetermined period, wherein the third mode has zero luminosity.

17. The method of claim 16, wherein the second mode immediately follows the first mode.

* * * * *